US008833828B2

(12) United States Patent
Maeyama et al.

(10) Patent No.: US 8,833,828 B2
(45) Date of Patent: Sep. 16, 2014

(54) GUIDE WHEEL DEVICE FOR GUIDE RAIL VEHICLE

(75) Inventors: Hiroyuki Maeyama, Tokyo (JP); Kousuke Katahira, Kawasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 298 days.

(21) Appl. No.: 13/498,170

(22) PCT Filed: Dec. 24, 2009

(86) PCT No.: PCT/JP2009/071385

§ 371 (c)(1), (2), (4) Date: Mar. 26, 2012

(87) PCT Pub. No.: WO2011/045871

PCT Pub. Date: Apr. 21, 2011

(65) Prior Publication Data

US 2012/0181805 A1 Jul. 19, 2012

(30) Foreign Application Priority Data

Oct. 14, 2009 (JP) ..... 2009-237048

(51) Int. Cl.
*B60B 17/00* (2006.01)
*B61F 5/32* (2006.01)

(52) U.S. Cl.
USPC ..... 295/1; 295/36.1

(58) Field of Classification Search
CPC ..... B61F 5/325; B60B 7/00; B60B 37/00; B61B 13/00
USPC ..... 295/1, 32, 35, 36.1, 44, 47; 104/243, 104/306; 301/111.01, 121
See application file for complete search history.

(56) References Cited

U.S. PATENT DOCUMENTS 1,206,583 A * 11/1916 Palley ..... 295/37
6,113,299 A 9/2000 Reichelt et al.

(Continued)

FOREIGN PATENT DOCUMENTS

CN 2536424 Y 2/2003
CN 201002617 Y 1/2008

(Continued)

OTHER PUBLICATIONS

The international Preliminary Report on Patentability, dated May 24, 2012, in connection with PCT/JP2009/071385.

(Continued)

*Primary Examiner* — Kip T Kotter
(74) *Attorney, Agent, or Firm* — Lowe Hauptman & Ham LLP

(57) ABSTRACT

A guide wheel device for a guide rail vehicle includes a wheel shaft rotatably supported on a bearing, and a main guide wheel and a branch guide wheel rotatably mounted to upper and lower portions of the wheel shaft, wherein the main guide wheel has a rotation center eccentric to an axis of the wheel shaft, a plurality of fitting body receiving portions are provided in an outer peripheral surface of the wheel shaft so as to be arranged sequentially in a circumferential direction, a fitting body to be fitted into the fitting body receiving portions is provided in the bearing, and fitting adjusting means capable of pressing the fitting body against the fitting body receiving portions toward the wheel shaft or releasing the pressing of the fitting body is provided.

4 Claims, 8 Drawing Sheets

(56) References Cited

U.S. PATENT DOCUMENTS

| | | | | |
|---|---|---|---|---|
| 6,431,082 | B1 * | 8/2002 | Kummeter et al. | 105/215.1 |
| 6,550,396 | B2 * | 4/2003 | Kummeter et al. | 105/215.1 |
| 7,644,664 | B2 * | 1/2010 | Nakao et al. | 104/243 |
| 2007/0289477 | A1 * | 12/2007 | Sobolewski | 105/215.2 |

FOREIGN PATENT DOCUMENTS

| | | | |
|---|---|---|---|
| CN | 201183118 | Y | 1/2009 |
| JP | 2030772 | A | 2/1990 |
| JP | 7040361 | A | 7/1995 |
| JP | 2582980 | Y2 | 10/1998 |
| JP | 3314343 | B2 | 8/2002 |
| JP | 2003146204 | A | 5/2003 |
| JP | 4125508 | B2 | 7/2008 |
| TW | 348137 | | 12/1998 |
| TW | I291447 | B | 12/2007 |

OTHER PUBLICATIONS

Notice of Allowance corresponding to JP2009-237048, dated Oct. 26, 2012.

Office Action mailed Nov. 28, 2013, corresponds to Chinese patent application No. 200980161723.7.

A TW Notice of Allowance, dated Jul. 24, 2012 in TW Application No. 099100096.

International Search Report for PCT/JP2009/071385 dated Apr. 6, 2010.

Notice of Allowance dated Oct. 1, 2013, corresponds to Korean patent application No. 10-2012-7008078, for which an explanation of relevance is attached.

Notification of the Decision to Grant a Patent Right for Invention issued Jun. 4, 2014, corresponds Chinese patent application No. 200980161723.7.

* cited by examiner

GUIDE WHEEL DEVICE FOR GUIDE RAIL VEHICLE

RELATED APPLICATIONS

The present application is a National Phase of International Application Number PCT/JP2009/071385, filed Dec. 24, 2009, and claims priority from, Japanese Application Number 2009-237048, filed Oct. 14, 2009.

TECHNICAL FIELD

The present invention relates to a guide wheel device for a guide rail vehicle that runs on a running track or the like.

BACKGROUND ART

Recently, in a new transportation system in which traffic vehicles run on a track or a set route on a road surface or the like, a guide wheel device is provided in a steering mechanism of a guide rail vehicle. In the guide wheel device, guide wheels 53 mounted to front and rear wheel trucks of a vehicle roll with respect to guide rails 52 provided on both the right and left sides of a running track 51 roll in contact with the guide rails 52, to thereby guide the running vehicle along the running track 51 as shown in FIG. 13.

Also, the guide rail 52 includes a main guide rail 52*a* provided along the running track 51 on both sides thereof, and a branch guide rail 52*b* provided at a branch position of the running track 51. Therefore, the guide wheel 53 is rotatably provided at each of both right and left end portions of front and rear guide lateral beams (not shown) extending in the vehicle width direction, and includes a main guide wheel 53*a* and a branch guide wheel 53*b* rotatably mounted to upper and lower portions of a wheel shaft 54 with the axis being eccentric. The main guide wheel 53*a* is in contact with the main guide rail 52*a*, and the branch guide wheel 53*b* is in contact with the branch guide rail 52*b*.

Meanwhile, in the guide wheel device for the guide rail vehicle of a side guide type having the main guide wheel 53*a* and the branch guide wheel 53*b* as described above, the wear rate of the main guide wheel 53*a* is known to be several times higher than that of the branch guide wheel 53*b* due to a difference in the contact speed and the contact frequency of the main guide wheel 53*a* and the branch guide wheel 53*b* with the guide rails 52*a* and 52*b*. Since there are limitations on the outer width of the main guide wheel 53*a* and the outer width of the branch guide wheel 53*b* from the positional relationship with the branch guide rail 52*b*, the rotation center of the main guide wheel 53*a* is provided eccentrically to the axis of the wheel shaft 54. Thus, it is necessary to perform wear adjustment by moving only the main guide wheel 53*a* to the outer side and thereby displacing the main guide wheel 53*a* toward the main guide rail 52*a* without changing the position of the branch guide wheel 53*b* by use of the eccentricity.

A guide wheel device having a structure in which wear adjustment can be performed on a guide wheel has been conventionally proposed (for example, Patent Literature 1). In the guide wheel device, a lever is bolted to a guide bearing at each wear adjustment position. As shown in FIG. 14, when a guide wheel 62 rotatably supported at both front and rear end portions of a guide arm 61 is worn to generate a gap of a predetermined width or more between the rail of a guide rail and the guide wheel 62, a bolt 66 that fixes to the guide arm 61 a rotation lever 65 fixed to a guide wheel shaft 63 by inhibiting relative rotation with a key 64 is loosened and removed from a threaded hole 67 of the guide arm 61. After that, an operation end portion 65*a* of the rotation lever 65 is operated.

The guide wheel shaft 63 is thereby rotated based on the rotation operation, and a shaft center C2 of the guide wheel shaft 63 eccentric by a distance e to a shaft center C1 of a support shaft 68 is moved to a changed center around the shaft center C1. Accordingly, the guide wheel 62 is moved to the outer side from the guide arm 61 by a distance corresponding to the displacement amount of the changed center from the shaft center C2 in the right and left direction of the guide arm 61. When an appropriate gap is obtained between the guide rail and the outer peripheral surface of the guide wheel 62 by the movement adjustment, the bolt 66 is screwed into the threaded hole 67 in an intermediate portion and fastened to fix the rotation lever 65, so that the wear adjustment of the guide wheel 62 is completed.

A large-diameter guide shaft portion 68*a* of the support shaft 68 is arranged at an upper portion of the guide arm 61, a small-diameter mounting shaft portion 68*b* is inserted into a mounting hole 61*a* of the guide arm 61, and a branch wheel 69 is supported at a branch wheel shaft portion 68*c* on the lower end side.

CITATION LIST

Patent Literature

Patent Literature 1: Japanese Patent No. 4125508

SUMMARY OF INVENTION

Technical Problem

However, in the above conventional guide wheel device, each portion needs to be loosely connected such that the guide wheel 62 having the biaxial structure is easily rotated by the rotation lever 65 in order to perform the wear adjustment on the guide wheel 62. Thus, rust occurs on each portion due to sliding wear or intruding rainwater in the conventional guide wheel device, so that various problems resulting from sticking or looseness may occur.

Since the conventional guide wheel device also has a complicated structure, a disassembly and maintenance operation performed in a maintenance check is complicated, and a higher maintenance cost is incurred.

The present invention has been made in view of the above circumstances, and it is an object of the present invention to provide a guide wheel device for a guide rail vehicle with a simple structure, which can be manufactured at low cost, and can be easily maintained while reducing the maintenance cost, and in which a wear adjustment position is not moved due to vibrations while the vehicle is running.

Solution to Problems

To solve the problems in the above conventional art, the present invention is a guide wheel device for a guide rail vehicle including a wheel shaft rotatably supported on a bearing, and a main guide wheel and a branch guide wheel rotatably mounted to upper and lower portions of the wheel shaft, wherein the main guide wheel has a rotation center eccentric to an axis of the wheel shaft, a plurality of fitting body receiving portions are provided in an outer peripheral surface of the wheel shaft so as to be arranged sequentially in a circumferential direction, a fitting body to be fitted into the fitting body receiving portion is provided in the bearing, and fitting adjusting means capable of pressing the fitting body against the fitting body receiving portion toward the wheel shaft or releasing the pressing of the fitting body is provided.

In the present invention, the fitting adjusting means includes a pressing spring that presses the fitting body toward the wheel shaft, and a pressing member that presses the pressing spring toward the fitting body, and the pressing member reciprocates in a pressing direction by a threaded structure.

Also, in the present invention, the fitting body receiving portion is one of a V groove, an arc groove, and a conical hole, and the fitting body is one of a spherical body, a shell-shaped body, and a conical body that can be fitted into the V groove, the arc groove, and the conical hole.

Furthermore, in the present invention, a tilt angle of a wall surface on a side opposing a rotational direction of the wheel shaft and to which the fitting body is pushed out of wall surfaces of each of the V groove, the arc groove, and the conical hole is smaller than a tilt angle of a wall surface on an opposite side therefrom.

Advantageous Effects of Invention

As described above, the guide wheel device for a guide rail vehicle according to the present invention includes a wheel shaft rotatably supported on a bearing, and a main guide wheel and a branch guide wheel rotatably mounted to upper and lower portions of the wheel shaft, wherein the main guide wheel has a rotation center eccentric to an axis of the wheel shaft, a plurality of fitting body receiving portions are provided in an outer peripheral surface of the wheel shaft so as to be arranged sequentially in a circumferential direction, a fitting body to be fitted into the fitting body receiving portion is provided in the bearing, and fitting adjusting means capable of pressing the fitting body against the fitting body receiving portion toward the wheel shaft or releasing the pressing of the fitting body is provided. Thus, the main guide wheel can be easily displaced to a desired position by operating the fitting adjusting means, and the wear adjustment operation time of the main guide wheel can be substantially reduced. Moreover, after the adjustment, the adjustment position is not moved due to vibrations while the vehicle is running, so that the main guide wheel can be held at the position. Since the device has a simple structure and can be easily maintained, the device can be manufactured at low cost, and the maintenance cost can be also reduced.

Also, in the present invention, the fitting adjusting means includes a pressing spring that presses the fitting body toward the wheel shaft, and a pressing member that presses the pressing spring toward the fitting body, and the pressing member reciprocates in a pressing direction by a threaded structure. Thus, the fitting body can be reliably and quickly fitted into and released from the fitting body receiving portion.

Moreover, in the present invention, the fitting body receiving portion is one of a V groove, an arc groove, and a conical hole, and the fitting body is one of a spherical body, a shell-shaped body, and a conical body that can be fitted into the V groove, the arc groove, and the conical hole. Thus, high accuracy is not required, so that the processing cost can be reduced, the stress concentration is decreased, and the shaft strength can be improved.

In the present invention, a tilt angle of a wall surface on a side opposing a rotational direction of the wheel shaft and to which the fitting body is pushed out of wall surfaces of each of the V groove, the arc groove, and the conical hole is smaller than a tilt angle of a wall surface on an opposite side therefrom. Thus, the wheel shaft is not rotated in the opposite direction from the wear adjustment direction, so that erroneous adjustment can be prevented.

DESCRIPTION OF EMBODIMENTS

In the following, embodiments of the present invention will be described in detail with reference to the drawings.

First Embodiment

Figure 1:
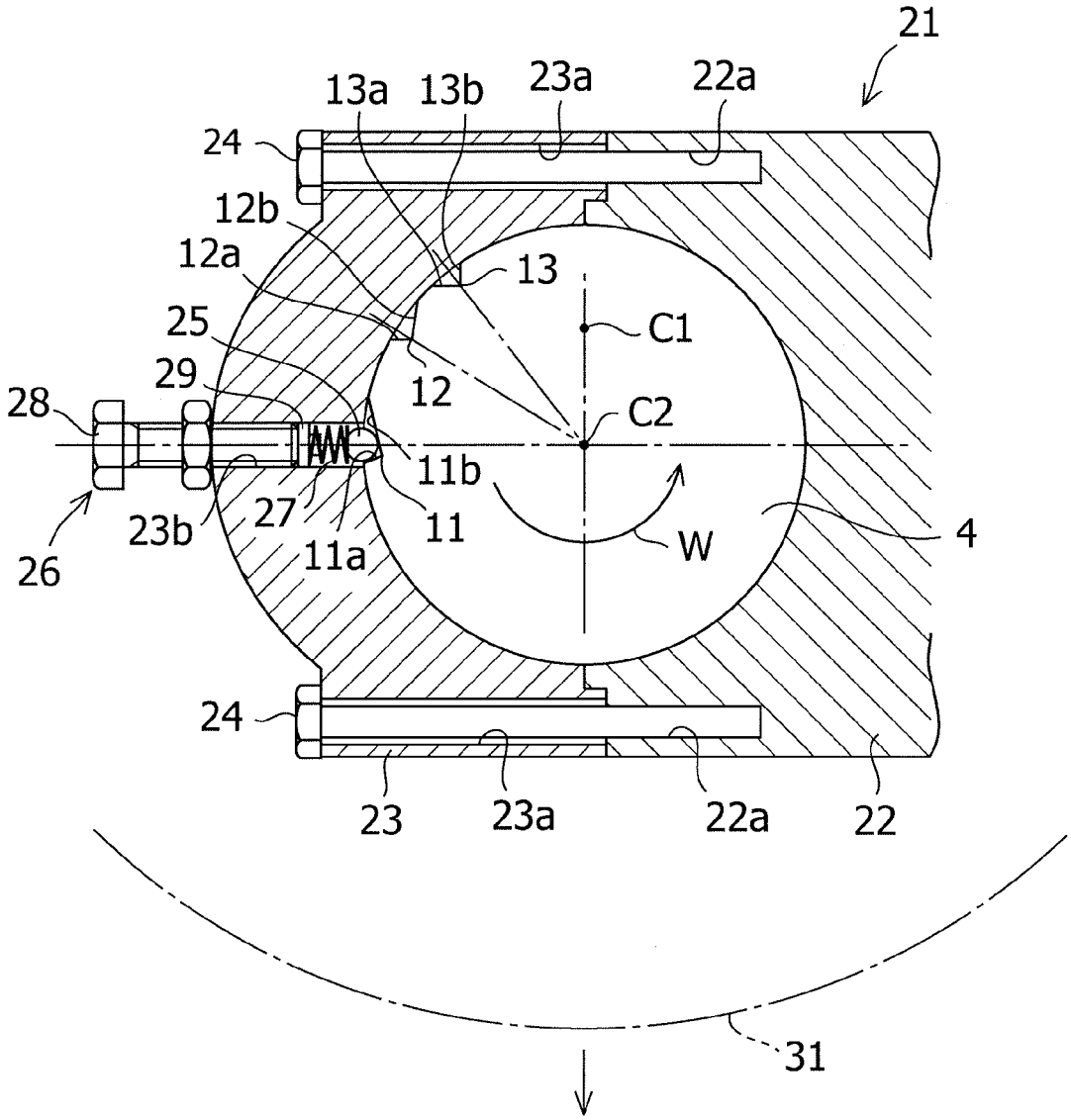
FIG. 1 is a cross sectional view illustrating a guide wheel device for a guide rail vehicle according to a first embodiment of the present invention.
Figure 2:
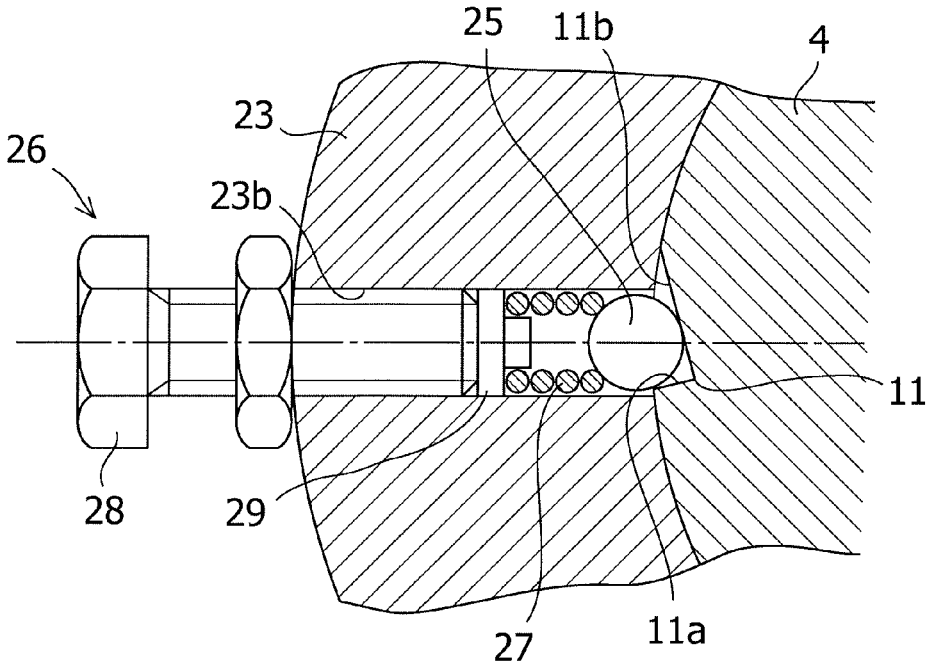
FIG. 2 is an enlarged cross sectional view illustrating a state in which a fitting body is fitted in a fitting body receiving portion by fitting adjusting means in the guide wheel device in FIG. 1.
Figure 3:
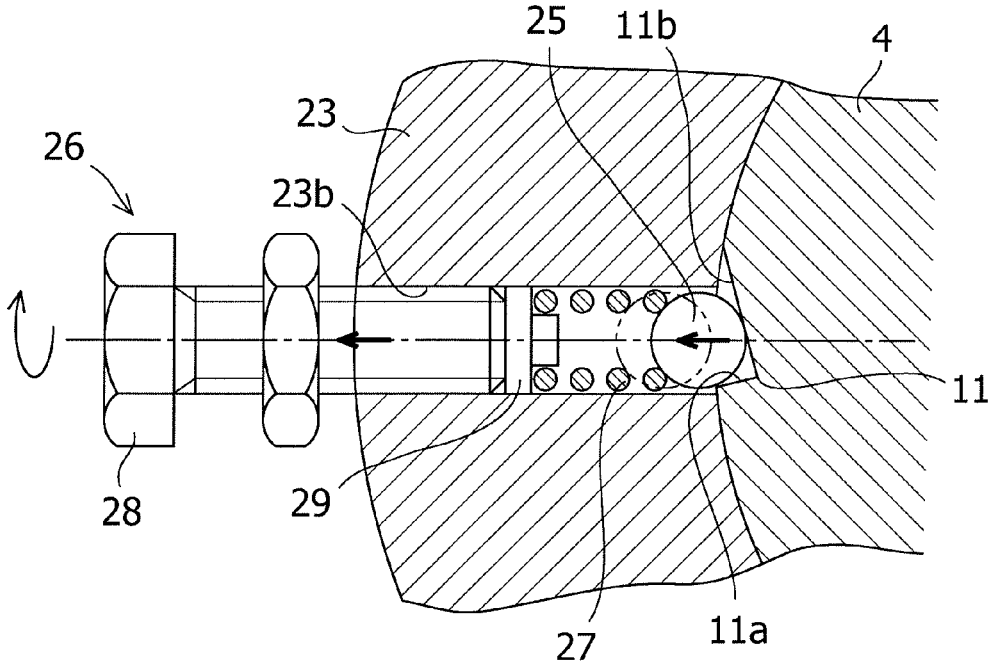
FIG. 3 is an enlarged cross sectional view illustrating a state in which the fitting body is disengaged from the fitting body receiving portion by the fitting adjusting means to release the fitting in the guide wheel device in FIG. 1.
Figure 4:
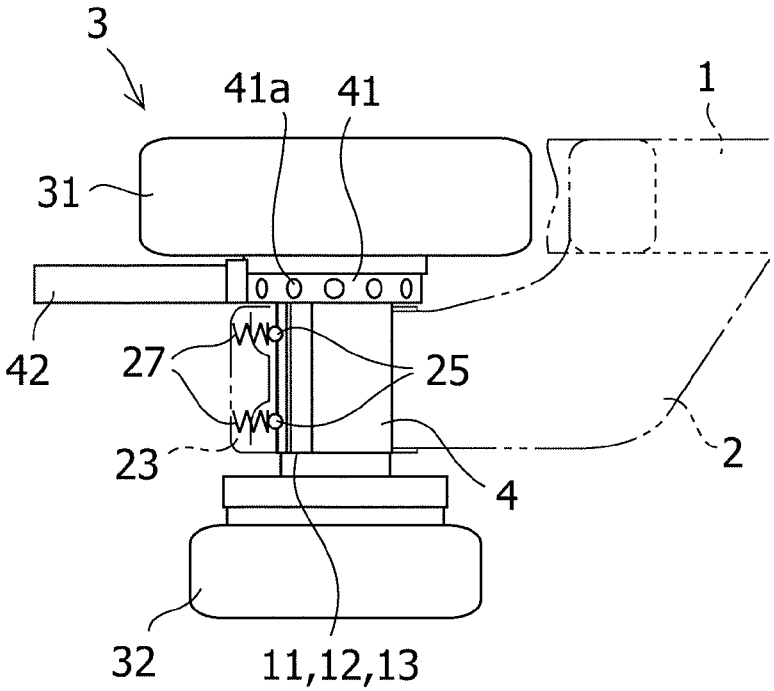
FIG. 4 is a schematic front view illustrating a state in which a wheel shaft is rotated by using a shaft rotation adjusting tool in the guide wheel device in FIG. 1.
Figure 5:
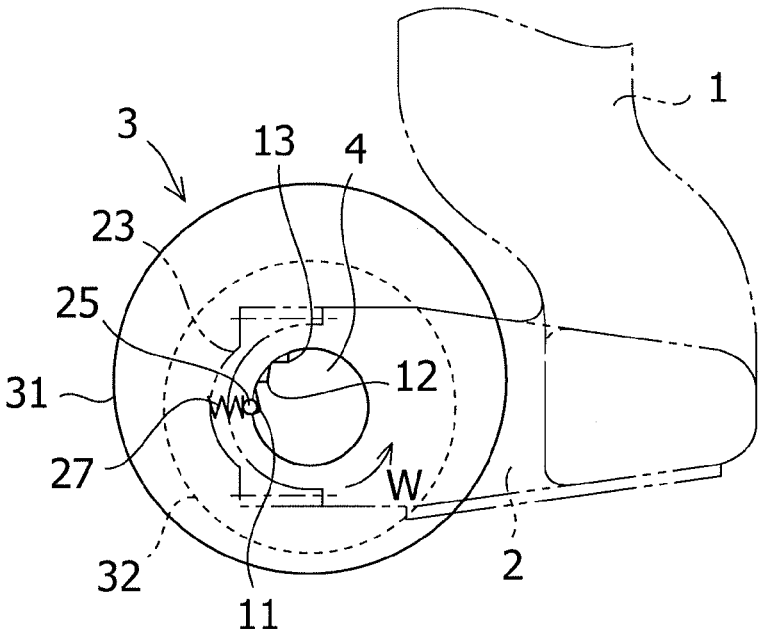
FIG. 5 is a schematic plan view illustrating a state in which a main guide wheel is at an initial position in the guide wheel device in FIG. 1.
Figure 6:
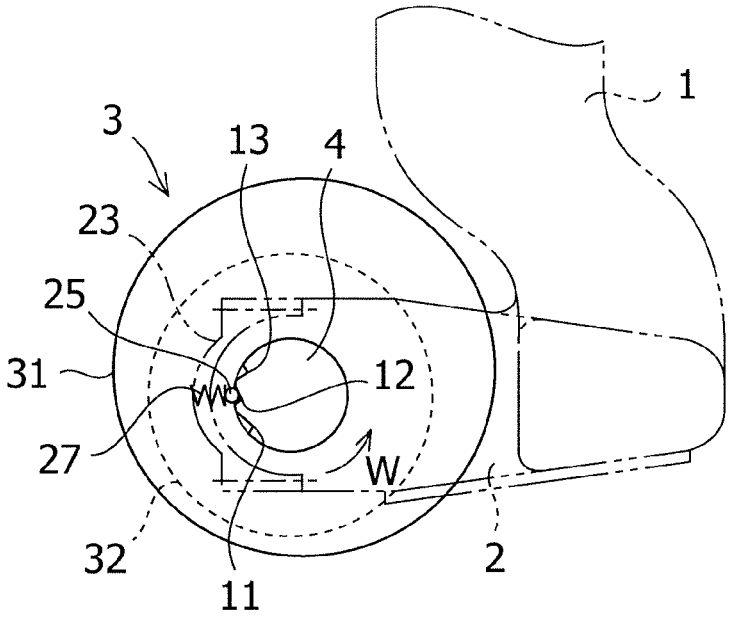
FIG. 6 is a schematic plan view illustrating a state in which the main guide wheel is at a subsequent wear adjustment position by rotating the wheel shaft in the guide wheel device in FIG. 1.
Figure 7:
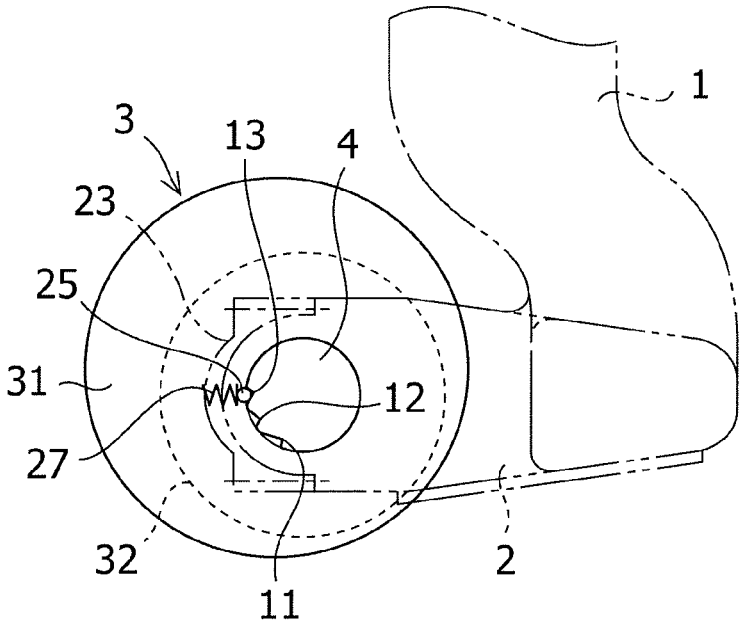
FIG. 7 is a schematic plan view illustrating a state in which the main guide wheel is at a final wear adjustment position by further rotating the wheel shaft in the guide wheel device in FIG. 1.

FIGS. 1 to 7 show a guide wheel device for a guide rail vehicle according to a first embodiment of the present invention, which is applied to a new transportation system or the like. FIG. 1 is a cross sectional view thereof. FIG. 2 is an enlarged cross sectional view of a state in which a fitting body is fitted in a fitting body receiving portion by fitting adjusting means. FIG. 3 is an enlarged cross sectional view of a state in which the fitting body is disengaged from the fitting body receiving portion by the fitting adjusting means to release the fitting. FIG. 4 is a schematic front view of a state in which a wheel shaft is rotated by using a shaft rotation adjusting tool. FIG. 5 is a schematic plan view of a state in which a main guide wheel is at an initial position. FIG. 6 is a schematic plan view of a state in which the main guide wheel is at a subsequent wear adjustment position by rotating the wheel shaft. FIG. 7 is a schematic plan view of a state in which the main guide wheel is at a final wear adjustment position by further rotating the wheel shaft.

The guide wheel device for the guide rail vehicle according to the first embodiment of the present invention includes guide wheels respectively mounted to front and rear wheel trucks of the guide rail vehicle with respect to guide rails respectively provided along a running track (a guide rail) as the route of the new transportation system on both the right and left sides of the running track. The guide rail vehicle runs while being side-guided along the running track with the guide wheels rolling in contact with the guide rails.

Two types of rails, a main guide rail and a branch guide rail provided in association with each other on the running track constitute the guide rail. The main guide rail is provided on both the right and left sides along the running track, and the branch guide rail is provided at a branch position that is located in a portion of the running track to guide the vehicle to another running track.

The guide wheel device includes a guide arm 2 that is mounted to each of both right and left end portions of front and rear guide lateral beams 1 extending in the vehicle width direction of the guide rail vehicle, and steers the running direction of the vehicle as shown in FIGS. 1 to 4. A guide wheel 3 is rotatably provided at a distal end portion of the guide arm 2 via a wheel shaft 4.

The guide wheel 3 includes a main guide wheel 31 and a branch guide wheel 32 rotatably mounted to upper and lower end portions of the wheel shaft 4. The main guide wheel 31 is arranged so as to contact the side surface of the main guide rail above the branch guide wheel 32. When the main guide wheel 31 is in contact with the main guide rail, a lateral load toward the inner side is applied to the main guide wheel 31 from the main guide rail on the outer side. Also, the branch guide wheel 32 is arranged so as to contact the side surface of the branch guide rail below the main guide wheel 31. When the branch guide wheel 32 is in contact with the branch guide rail, a lateral load toward the outer side is applied to the branch guide wheel 32 from the branch guide rail on the inner side. As described above, the main guide wheel 31 or the branch guide wheel 32 receives the lateral load from the main guide rail or the branch guide rail, so that the guide rail vehicle can run on the running track on a predetermined travel route.

The guide wheel device according to the first embodiment of the present invention has a structure in which wear adjustment can be performed on the main guide wheel 31. The main guide wheel 31 is arranged with a rotation center C1 thereof being eccentric to an axis C2 of the wheel shaft 4. Therefore, the wheel shaft 4 is formed in a crank shape in which a vertical intermediate portion is bent in the middle, and the intermediate portion is rotatably supported by a bearing 21 mounted to a distal end portion of the guide arm 2. That is, the guide wheel device according to the present embodiment employs a crankshaft system in which an inner ring portion of the bearing 21 and the intermediate portion of the wheel shaft 4 are directly attached to each other. The rotation center of the branch guide wheel 32 is arranged at the same position as the axis C2 of the wheel shaft 4.

As shown in FIGS. 1 to 4, a plurality (three in the present embodiment) of fitting body receiving portions 11, 12, and 13 are provided in the outer peripheral surface of the wheel shaft 4 so as to be arranged at a predetermined interval in the circumferential direction. In order to avoid confusion in an adjustment operation, the three fitting body receiving portions 11, 12, and 13 are sequentially arranged at portions where the rotating wheel shaft 4 is to be fixed in the order corresponding to the positions (first to third) of the wear adjustment amount of the main guide wheel 31 in the same direction, and extend in the axial direction (the vertical direction) of the wheel shaft 4.

Moreover, the fitting body receiving portions 11, 12 and 13 are V grooves formed to a depth into which the fitting body described below is partly fitted. The tilt angles of wall surfaces 11*a*, 12*a* and 13*a* located on the side opposing a rotational direction W of the wheel shaft 4 as the wear adjustment rotational direction of the main guide wheel 31 and on the side to which the fitting body described below is pushed, out of the opposing wall surfaces of the V grooves of the respective fitting body receiving portions 11, 12 and 13, are respectively set to be smaller than the tilt angles of wall surfaces 11*b*, 12*b* and 13*b* on the opposite side therefrom. The opposing wall surfaces of the V groove are set to different tilt angles from each other as described above, so that the wheel shaft 4 is made easy to rotate in the order of the first fitting body receiving portion 11, the second fitting body receiving portion 12, and the third fitting body receiving portion 13, and is made difficult to rotate in the opposite direction. Accordingly, erroneous adjustment is prevented.

A shaft rotating flange with holes 41 is also provided in an outer peripheral portion of the wheel shaft 4 located between the main guide wheel 31 and the bearing 21 as shown in FIG. 4. A plurality of tool fitting holes 41*a* are provided in the flange 41 at a predetermined pitch in the circumferential direction, and a distal end portion of a shaft rotation adjusting tool 42 is fitted into the tool fitting holes 41*a*. Accordingly, when the distal end portion of the shaft rotation adjusting tool 42 is fitted into one of the tool fitting holes 41*a* to rotate the wheel shaft 4 in the rotational direction W by holding the shaft rotation adjusting tool 42 on the proximal end portion side, or when the distal end portion of the shaft rotation adjusting tool 42 is repeatedly fitted into and disengaged from the tool fitting holes 41*a* to rotate the wheel shaft 4 in the rotational direction W, the wheel shaft 4 is rotated to the desired positions of the fitting body receiving portions 11, 12 and 13.

Meanwhile, the bearing 21 in the present embodiment is assembled by fastening a bearing body 22 having a threaded hole 22*a* and a bearing lid 23 having a bolt hole 23*a* by a fastening bolt 24. The inner ring portion thereof rotatably supports the intermediate portion of the wheel shaft 4. The fastening bolt 24 is formed to a length sufficient to be inserted through the bolt hole 23*a* of the bearing lid 23 and screwed into the threaded hole 22*a* of the bearing body 22 and fastened.

A fitting body 25 to be fitted into the fitting body receiving portions 11, 12 and 13 provided in the outer peripheral surface of the wheel shaft 4, and fitting adjusting means 26 capable of pressing the fitting body 25 against the fitting body receiving portions 11, 12 and 13 toward the wheel shaft 4 or releasing the pressing of the fitting body 25 are also provided at each of upper and lower two positions (or more) of a center portion of the bearing lid 23. The fitting body 25 is a spherical body (for example, a steel ball) having a size and a shape to be fitted into the V grooves of the fitting body receiving portions 11, 12 and 13 on the wheel shaft 4 side.

The fitting adjusting means 26 includes a pressing spring 27 that presses the fitting body 25 toward the wheel shaft 4, a pressing member 28 that presses the pressing spring 27 toward the fitting body 25, and a spring seat member 29 located between the pressing spring 27 and the pressing member 28. The pressing member 28 is configured to reciprocate in the pressing direction by a threaded structure. Therefore, a through path 23*b* in which a female thread is formed to be screwed with a male thread portion on the distal end side of the pressing member 28 is provided at each of the upper and lower two positions of the center portion of the bearing lid 23. The fitting body 25, the pressing spring 27, the spring seat member 29, and the distal end side of the pressing member 28 are movably arranged within the respective through paths 23*b*. Moreover, a portion of the fitting body 25 is arranged so as to appear from and disappear into the inner peripheral surface of the bearing lid 23 at a position where the through path 23*b* is provided. The proximal-end head portion side of the pressing member 28 is arranged projecting from the outer peripheral surface of the bearing lid 23.

In the guide wheel device for the guide rail vehicle according to the first embodiment of the present invention having the above configuration, when the main guide wheel 31 in contact with the main guide rail is worn while the guide rail vehicle is running, and a gap of a predetermined width or greater is generated between the main guide rail and the main guide wheel 31, the fastening bolt 24 is first loosened without detaching the bearing lid 23 from the bearing body 22, to thereby form a small gap between the outer peripheral surface of the wheel shaft 4 and the inner peripheral surface of the bearing lid 23. A deflection allowance required for the fitting body 25 to cross over the V groove of the first fitting body receiving portion 11 at the initial position shown in FIGS. 1 to 3 and 5 is provided to the pressing spring 27 by slightly loosening the pressing member 28 of the fitting adjusting means 26, to thereby return the fitting body 25 toward the bearing lid 23.

Subsequently, the distal end portion of the shaft rotation adjusting tool 42 is inserted into the tool fitting hole 41*a* of the shaft rotating flange with holes 41, to rotate the wheel shaft 4 in the rotational direction W as shown in FIG. 4. The fitting body 25 thereby crosses over the V groove of the first fitting body receiving portion 11. When the fitting body 25 reaches the V groove of the second fitting body receiving portion 12 at the subsequent wear adjustment position, a portion of the fitting body 25 enters into the V groove of the second fitting body receiving portion 12 and is fitted therein by the spring force of the pressing spring 27, to determine the wear adjustment position. The fastening bolt 24 of the bearing lid 23 is thereafter fastened to fix the bearing lid 23 to the bearing body 22, and the pressing member 28 is also fastened to lock the wheel shaft 4. Accordingly, with the position of the wheel shaft 4 being fixed, the main guide wheel 31 is moved toward the main guide rail by a distance corresponding to the eccentric amount, and an appropriate gap is obtained between the outer peripheral surface of the main guide wheel 31 and the main guide rail. The wear adjustment of the main guide wheel 31 is thereby completed (see FIG. 6).

The wear adjustment of the main guide wheel 31 can be performed by the operation in the same procedure as above when the main guide wheel is further displaced from the position of the second fitting body receiving portion 12 shown in FIG. 6 to the third fitting body receiving portion 13 at the subsequent wear adjustment position shown in FIG. 7.

In the guide wheel device for the guide rail vehicle according to the first embodiment of the present invention, it is not necessary to detach the bearing lid 23 of the bearing 21 from the bearing body 22, and the adjustment operation can be performed only by loosening the fastening bolt 24. Also, the wheel shaft 4 can be rotated to and locked at the fitting body receiving portions 11, 12 and 13 at the desired positions by operating the fitting adjusting means 26, so that the wear adjustment of the main guide wheel 31 can be simply performed. Since the fitting body 25 enters into the V grooves of the fitting body receiving portions 12 and 13 and is fitted therein by the spring force of the pressing spring 27 that is pressed by the pressing member 28 after the wear adjustment of the main guide wheel 31, the adjustment position is not moved due to vibrations while the vehicle is running.

Second Embodiment

Figure 8:
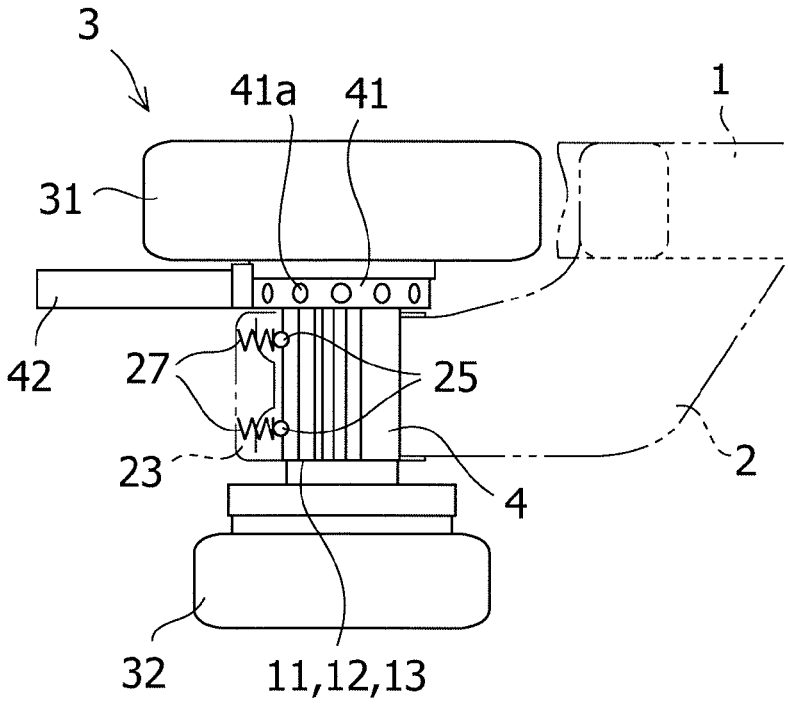
FIG. 8 is a schematic front view illustrating a state in which a wheel shaft is rotated by using a shaft rotation adjusting tool in a guide wheel device for a guide rail vehicle according to a second embodiment of the present invention.
Figure 9:
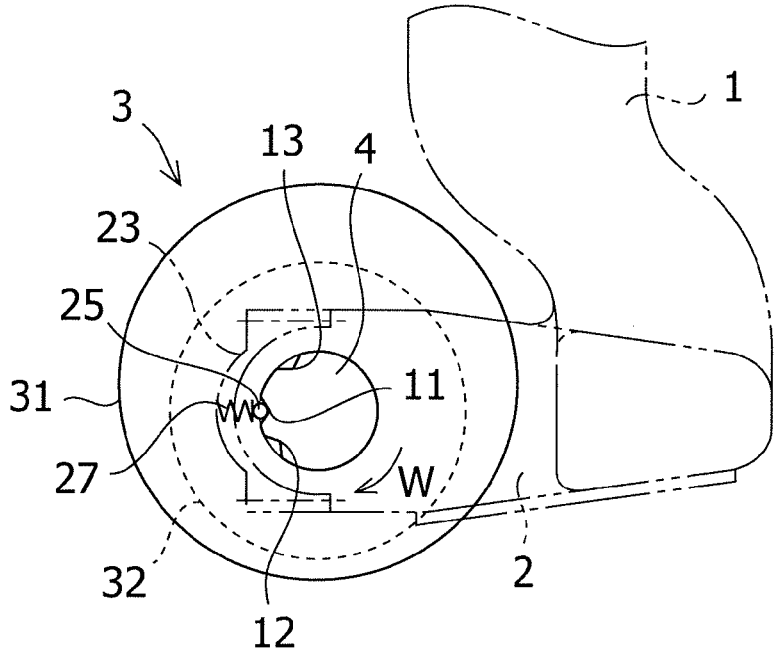
FIG. 9 is a schematic plan view illustrating a state in which a main guide wheel is at an initial position in the guide wheel device in FIG. 8.
Figure 10:
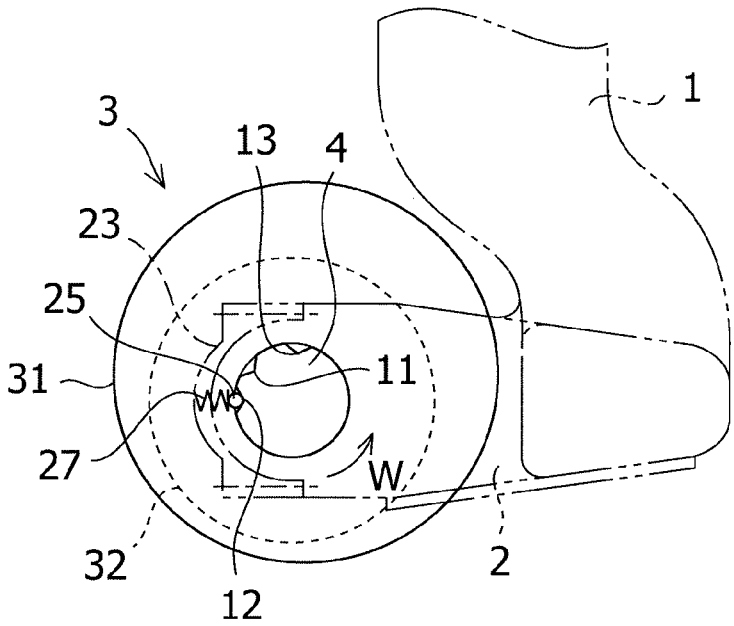
FIG. 10 is a schematic plan view illustrating a state in which the main guide wheel is at a subsequent wear adjustment position by rotating the wheel shaft in the forward direction in the guide wheel device in FIG. 8.
Figure 11:
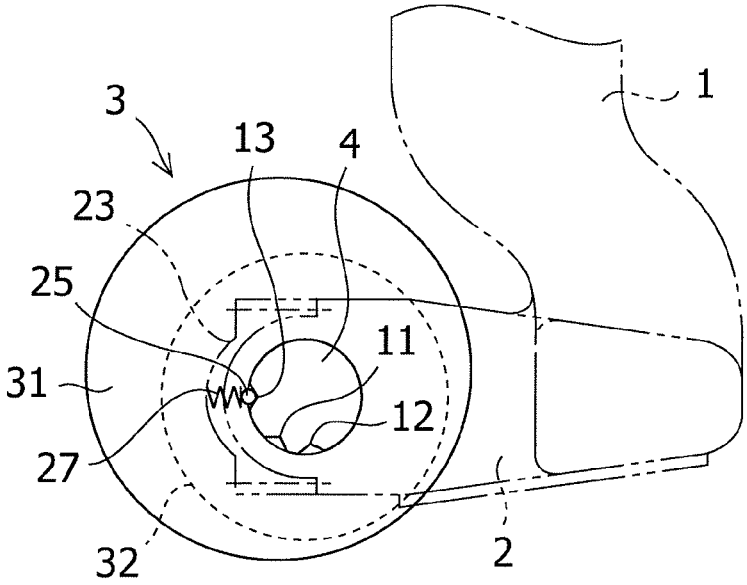
FIG. 11 is a schematic plan view illustrating a state in which the main guide wheel is at a final wear adjustment position by rotating the wheel shaft in the reverse direction in the guide wheel device in FIG. 8.

FIGS. 8 to 11 show a guide wheel device for a guide rail vehicle according to a second embodiment of the present invention, which is applied to the new transportation system. FIG. 8 is a schematic front view of a state in which a wheel shaft is rotated by using a shaft rotation adjusting tool. FIG. 9 is a schematic plan view of a state in which a main guide wheel is at an initial position. FIG. 10 is a schematic plan view of a state in which the main guide wheel is at a subsequent wear adjustment position by rotating the wheel shaft in the forward direction. FIG. 11 is a schematic plan view of a state in which the main guide wheel is at a final wear adjustment position by rotating the wheel shaft in the reverse direction.

Unlike in the above first embodiment, in the second embodiment, the second fitting body receiving portion 12 at the subsequent wear adjustment position and the third fitting body receiving portion 13 at the final wear adjustment position are arranged in the forward and reverse rotational directions with respect to the first fitting body receiving portion 11 at the initial position provided on the wheel shaft 4 as shown in FIGS. 8 to 11. The tilt angles of the both-side wall surfaces 11*a*, 12*a*, 13*a*, 11*b*, 12*b*, and 13*b* forming the V grooves of the fitting body receiving portions 11, 12 and 13 are equal.

The other components are the same as those in the first embodiment, and the same members as those in the first embodiment are assigned the same reference numerals. The wear adjustment operation procedure of the main guide wheel 31 in the second embodiment is also the same as that in the above first embodiment except that the wheel shaft 4 is rotated in the forward and reverse rotational directions W.

In the guide wheel device according to the second embodiment, the second fitting body receiving portion 12 at the subsequent wear adjustment position and the third fitting body receiving portion 13 at the final wear adjustment position are arranged in the forward and reverse rotational directions with respect to the first fitting body receiving portion 11 at the initial position provided on the wheel shaft 4. Therefore, the same effects as those in the above first embodiment can be obtained, and a large wear adjustment amount of the main guide wheel 31 is ensured.

Although the embodiments of the present invention have been described above, the present invention is not limited to the aforementioned embodiments, and various modifications and changes may be made based on the technical concept of the present invention.

Figure 12:
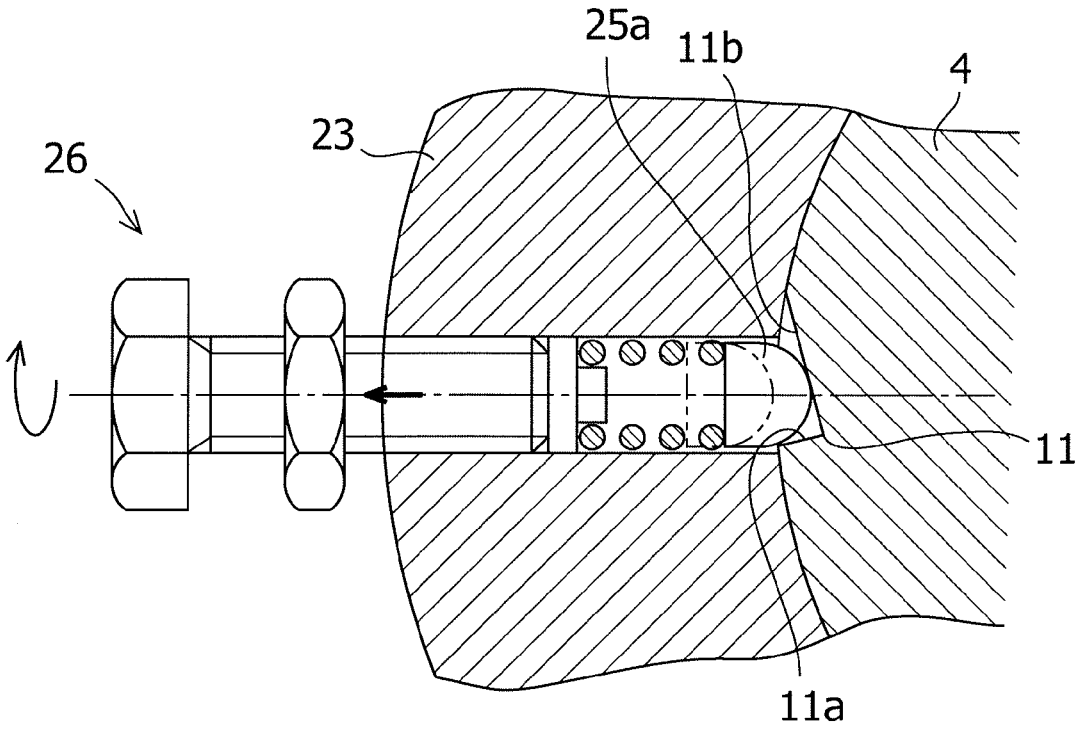
FIG. 12 is an enlarged cross sectional view illustrating a state in which a fitting body is disengaged from a fitting body receiving portion by fitting adjusting means to release the fitting in a guide wheel device for a guide rail vehicle according to a modification of the embodiment of the present invention.
Figure 13:
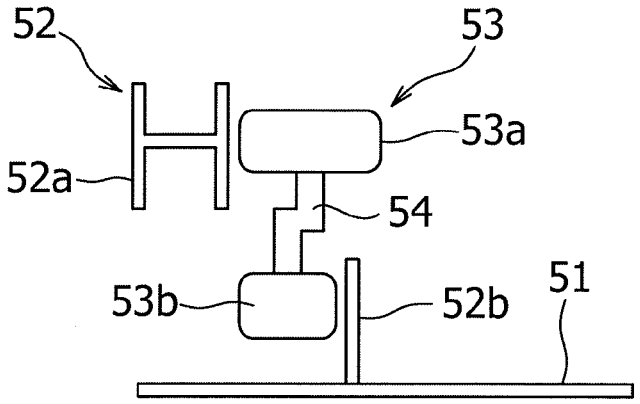
FIG.13 (RELATED ART)
FIG. 13 is a schematic front view illustrating a guide wheel device for a conventional guide rail vehicle.
Figure 14:
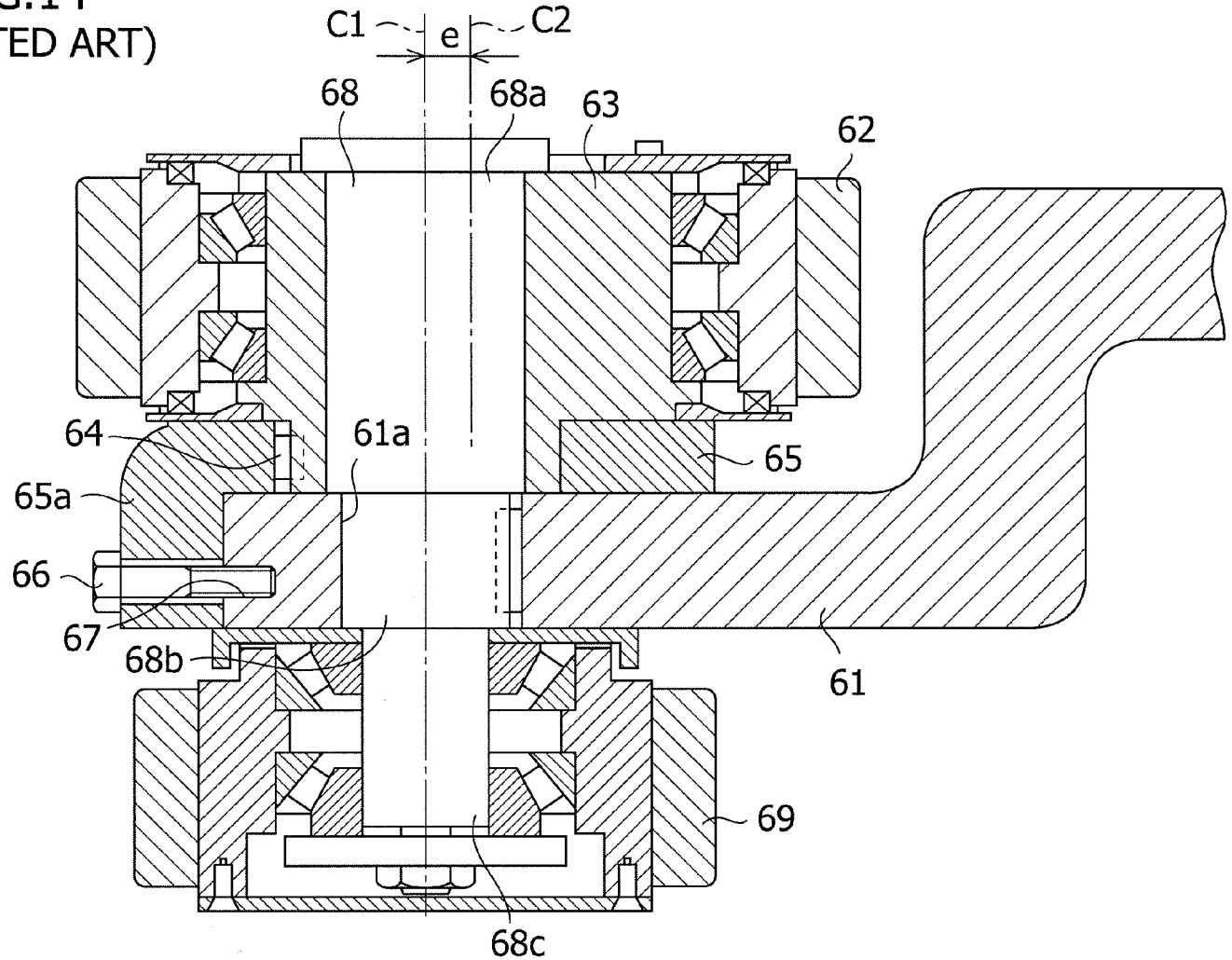
FIG.14 (RELATED ART)
FIG. 14 is a vertical sectional view illustrating a guide wheel device for another conventional guide rail vehicle.

For example, the fitting body receiving portions 11, 12 and 13 of the wheel shaft 4 are the V grooves and the fitting body 25 is the spherical body in the aforementioned embodiments. However, as long as the fitting body can be reliably and smoothly fitted into and disengaged from the fitting body receiving portion, the fitting body receiving portions 11, 12 and 13 may be one of an arc groove and a conical hole, and one of a shell-shaped fitting body 25*a* shown in FIG. 12 and a conical fitting body may be employed instead of the spherical fitting body 25. Although the bearing 21 has a structure in which the bearing body 22 and the bearing lid 23 are separated in the aforementioned embodiments, the guide wheel device for the present invention may be also applied to a bearing having an integral structure without a bearing lid. Furthermore, in the guide wheel device in the aforementioned embodiments, the wheel shaft 4 employs the crankshaft system. However, the guide wheel device according to the present invention may be also applied to a uniaxial system as shown in FIG. 14.

REFERENCE SYMBOLS LIST

1: Guide lateral beam
2: Guide arm
3: Guide wheel
4: Wheel shaft
11, 12, 13: Fitting body receiving portion
21: Bearing
22: Bearing body
23: Bearing lid
24: Fastening bolt
25, 25*a*: Fitting body
26: Fitting adjusting means
27: Pressing spring
28: Pressing member
31: Main guide wheel
32: Branch guide wheel
41: Shaft rotating flange with holes
41*a*: Tool fitting hole
42: Shaft rotation adjusting tool
C1: Rotation center of the main guide wheel
C2: Axis of the wheel shaft
51: Running track
52: Guide rail
52*a*: Main guide rail
52*b*: Branch guide rail
53: Guide wheel
53*a*: Main guide wheel
53*b*: Branch guide wheel
54: Wheel shaft
61: Guide arm
62: Guide wheel
63: Guide wheel shaft
64: Key
65: Rotation lever
66: Bolt
67: Threaded hole
68: Support shaft
69: Branch wheel

The invention claimed is:

1. A guide wheel device for a guide rail vehicle comprising a wheel shaft rotatably supported on a bearing, and a main guide wheel and a branch guide wheel rotatably mounted to upper and lower portions of the wheel shaft, wherein the main guide wheel has a rotation center eccentric to an axis of the wheel shaft, a plurality of fitting body receiving portions are provided in an outer peripheral surface of the wheel shaft so as to be arranged sequentially in a circumferential direction, a fitting body to be fitted into the fitting body receiving portion is provided in the bearing, and fitting adjusting means capable of pressing the fitting body against the fitting body receiving portion toward the wheel shaft or releasing the pressing of the fitting body is provided.

2. The guide wheel device for a guide rail vehicle according to claim 1, wherein the fitting adjusting means includes a pressing spring that presses the fitting body toward the wheel shaft, and a pressing member that presses the pressing spring toward the fitting body, and the pressing member reciprocates in a pressing direction by a threaded structure.

3. The guide wheel device for a guide rail vehicle according to claim 1, wherein the fitting body receiving portion is one of a V groove, an arc groove, and a conical hole, and the fitting body is one of a spherical body, a shell-shaped body, and a conical body that can be fitted into the V groove, the arc groove, and the conical hole.

4. The guide wheel device for a guide rail vehicle according to claim 3, wherein a tilt angle of a wall surface on a side opposing a rotational direction of the wheel shaft and to which the fitting body is pushed out of wall surfaces of each of the V groove, the arc groove, and the conical hole is smaller than a tilt angle of a wall surface on an opposite side therefrom.

* * * * *